United States Patent [19]

Yoneyama et al.

[11] Patent Number: 4,943,520

[45] Date of Patent: Jul. 24, 1990

[54] SILVER HALIDE PHOTOGRAPHIC MATERIAL CONTAINING ANTISTATIC AGENTS

[75] Inventors: Masakazu Yoneyama; Yasuo Mukunoki, both of Kanagawa, Japan

[73] Assignee: Fuji Photo Film Co., Ltd., Kanagawa, Japan

[21] Appl. No.: 185,224

[22] Filed: Apr. 25, 1988

[30] Foreign Application Priority Data

Apr. 24, 1987 [JP] Japan ..... 62-101455

[51] Int. Cl.[5] ..... G03C 1/94

[52] U.S. Cl. ..... 430/527; 430/523; 430/637

[58] Field of Search ..... 430/527, 637, 523

[56] References Cited

U.S. PATENT DOCUMENTS

| | | | |
|---|---|---|---|
| 3,459,790 | 8/1969 | Smith | 430/527 |
| 3,551,152 | 12/1970 | Mackey et al. | 430/527 |
| 3,586,504 | 6/1971 | Coates et al. | 430/637 |
| 3,725,079 | 4/1973 | Mackey | 430/637 |
| 3,725,080 | 4/1973 | Mackey | 430/637 |
| 4,367,283 | 1/1983 | Nakayama et al. | 430/637 |
| 4,596,766 | 6/1986 | Nemori et al. | 430/637 |
| 4,623,615 | 11/1986 | Yokoyama et al. | 430/637 |

*Primary Examiner*—Jack P. Brammer

*Attorney, Agent, or Firm*—Sughrue, Mion, Zinn, Macpeak & Seas

[57] ABSTRACT

A silver halide photographic material composed of a support having thereon at least one photosensitive silver halide emulsion layer, at least one layer of the material containing a compound of formula (I):

A—X—Y—B (I)

wherein A represents a substituted or unsubstituted alkyl group, a substituted or unsubstituted alkenyl group or a substituted or unsubstituted aralkyl gruop, each having from 8 to 25 carbon atoms; X represents $$-O-,\ -\underset{\underset{O}{\|}}{C}O-,\ -S-,\ -\overset{\overset{R}{|}}{N}-,$$

$$-\overset{\overset{R}{|}}{C}ON- \text{ or } -SO_2\overset{\overset{R}{|}}{N};$$

R represents an alkyl group having from 1 to 10 carbon atoms or —Y—B; Y represents a group comprising units $$\left(CH_2CH_2O\right)_a,\ \left(CH_2\underset{\underset{OH}{|}}{C}HCH_2O\right)_b, \text{ and}$$

$$\left(\left(CH_2\right)_c\underset{\underset{R'}{|}}{C}H-CH_2O\right)_d$$

wherein a is a number from 5 to 50; b is a number from 2 to 20; c is a number from 0 to 3; d is a number from 0 to 20; R′ represents a hydrogen atom, a methyl group or a phenyl group, with the proviso that, when R′ represents a methyl group or a phenyl group, c represents 0, and, when R′ represents a hydrogen atom, c represents a number from 1 to 3; and B represents a hydrogen atom, a substituted or unsubstituted alkyl group having up to 8 carbon atoms or a substituted or unsubstituted phenyl group. The antistatic properties of the material are excellent.

8 Claims, No Drawings

SILVER HALIDE PHOTOGRAPHIC MATERIAL CONTAINING ANTISTATIC AGENTS

FIELD OF THE INVENTION

The present invention relates to a silver halide photographic material having excellent antistatic properties, and in particular, to one suitable for development by automatic developing machines free from deficiencies (for example, drying unevenness, film stain, etc.) caused by staining of processing solutions, adhesion of water-insoluble substances to conveyor rollers and precipitation of water-insoluble substances in processing solutions during development.

BACKGROUND OF THE INVENTION

A photographic material generally has an electric insulating support and a photographic layer, and therefore, an electric charge is often accumulated on the material during manufacture or use thereof because of contact, friction or peeling with the surface of the same or different substance. The accumulated static charge causes various problems, the most significant of which is that the light-sensitive emulsion layer in the material is sensitized by discharge of the static charge accumulated before development, to cause spots or branched or feather-like streaks on the photographic film developed. These are called "static marks", which lower the commercial value of photographic films if they do not ruin them. For example, if such static marks occur in medical or industrial X-ray films, etc., it is easily recognized that these would result in an extremely dangerous judgment. The phenomenon of static marks appears only after development of films and is therefore an extremely troublesome problem. In addition, the accumulated static charge would cause secondary disadvantages, for example, including adhesion of dust on the surface of the film or difficulty of uniform coating thereon.

Such static charge is often accumulated during manufacture and use of photographic materials, as mentioned above. In particular, this is caused by contact and friction between photographic film and rollers during manufacture of films, or by separation of the emulsion surface from the support surface during reeling up or reeling back of films. In the case of finished products, the static charge often occurs by separation of the emulsion surface from the support surface during reeling-up and exchange of photographic films. This would also occur because of contact of X-ray films with machine parts or fluorescent sensitized paper in automatic photographing machines and the successive separation of the films from the parts or paper in the machine. The static marks of photographic materials caused by the accumulation of such static charge become more remarkable with elevation of the sensitivity of the photographic materials as well as with acceleration of the processing speed. In particular, photographic materials recently have been subjected to severe conditions in many cases, for example., for extreme elevation of the sensitivity of the materials and for rapid coating, rapid photographing and rapid automatic development of the materials, and therefore, the materials are increasingly damaged by static marks.

In order to eliminate the difficulties of static charge mentioned above, it is preferred to add an antistatic agent to photographic materials. However, the antistatic agents generally used in other technical fields cannot always be used for photographic materials, since the antistatic agents which can be used for photographic materials are restricted by various conditions which are specific to photographic materials. Specifically, the antistatic agents which can be used for photographic materials are required to satisfy various conditions, in addition to excellent antistatic properties: they must not have any bad influences on photographic characteristics, such as sensitivity, fog property, graininess, sharpness, etc.; they must not have any bad influences on the film strength of photographic materials (that is, the photographic materials must not become easily damaged by friction or scratches because of the addition of the antistatic agents); they must not have any bad influences on the blocking-resistance of photographic materials (that is, the surface of the photographic material must not become easily adherable to the surface of other photographic materials or other substances because of the addition of the antistatic agents); they must have not cause the acceleration of fatigue of processing solutions for photographic materials, stain conveyer rollers, lower the adhesion strength between the constituting layers of photographic materials, etc. Accordingly, the application of antistatic agents to photographic materials is restricted by various conditions.

One method for eliminating static charge difficulties is to elevate the electroconductivity on the surface of photographic materials so that the static charge may rapidly be diffused away in a short period of time prior to discharge of the accumulated charge.

Accordingly, various methods for improving the electroconductivity of the support and the coated layers of photographic materials have been investigated and utilization of various hydroscopic substances, water-soluble inorganic salts, certain kinds of surfactants, polymers, etc. has been tried.

Among them, surfactants are important in view of their antistatic capacity, and for example, there are known anion, betaine and cation surfactants described in U.S. Pat. No. 3,082,123, 3,201,251, 3,519,561, 3,625,695, West German Patent Nos. 1,552,408, 1,597,472, Japanese Patent Application (OPI) Nos. 85826/64, 129623/78, 159223/79, 197213/73 (the term "OPI" as used herein means a "published unexamined Japanese patent application"), Japanese Patent Publication Nos. 39312/71, 11567/74, 46755/76, 15517/80, as well as nonionic surfactants described in Japanese Patent Publication No. 17882/73, Japanese Patent Application (OPI) No. 80023/77, West German Patent Nos. 1,422,809, 1,422,818, Australian Patent No. 54441/1959.

However, these substances are specific to film supports and photographic compositions, and therefore, some are effective only for specific film supports and specific photographic light-sensitive emulsions and photographic constitutional elements, but cannot be used for other film supports and photographic constitutional elements as an antistatic agent, as described in, for example, Japanese Patent Publication No. 17882/73 which corresponds to U.S. Pat. No. 3,415,649. Also, some have excellent antistatic properties but have bad influences on the photographic characteristics of photographic materials, such as sensitivity, fog properties, graininess or sharpness of photographic emulsions, or they stain processing solutions for development or cause adhesion of insoluble substances onto rollers during development. Accordingly, it has been extremely difficult to apply these substances to photographic materials.

The antistatic technique using nonionic surfactants is closely related to the coating aids used together with surfactants. These surfactants may be effective for improving the antistatic property of photographic materials, but in the use of the surfactants no consideration is taken on the probability of staining of processing solutions or conveyor rollers in development, which causes severe accidents in films processed.

For example, Japanese Patent Publication No. 9610/76 (corresponding to U.S. Pat. No. 3,850,641) discloses that phenol-formalin condensation product-/ethylene oxide addition-polymers are effective as an antistatic agent when used together with various coating aids. However, the method of the publication does not solve the problems caused by staining during development step.

Specifically, the conveyor roller stain which is considered to be caused by the dry deposit formed on the rollers is extremely severe and causes a significant problem of density unevenness of films.

Japanese Patent Application (OPI) No. 29715/78 (corresponding to British Patent No. 1548799) discloses photographic light-sensitive materials which contain particular anionic surfactants and polyoxyethylene series nonionic surfactants. However, even by the use of the combined surfactants, the film damage caused by staining or processing solutions or conveyor roller in development process could not be solved.

Recently, a method of reducing the amount of water used for development processing for the purpose of preventing environmental pollution, economizing water resources, reducing manufacturing costs and simplifying processing apparatus, etc., has been developed, along with a method of reducing the amount of replenishers to be used for the purpose of reducing manufacturing costs and a method of increasing the concentration of processing solutions for the purpose of shortening the processing time. Under these situations, the staining of processing solutions and the deposition of water-insoluble substances onto conveyor rollers are becoming more and more noticeable, and are significant problems in the recent photographic processing field.

SUMMARY OF THE INVENTION

A first object of the present invention is to provide a photographic light-sensitive material which is sufficiently antistatic so as not to cause staining of processing solutions and rollers in development procedure.

A second object of the present invention is to provide a photographic light-sensitive material which is sufficiently antistatic so as not to cause staining of other photographic light-sensitive materials to be processed successively.

A third object of the present invention is to provide a photographic light-sensitive material which is sufficiently antistatic without deteriorating the photographic characteristics of the material, such as sensitivity, etc.

A fourth object of the present invention is to provide a photographic light-sensitive material with constant antistatic properties even after storage for a long period of time.

It has been discovered that these and other objects of the present invention can be attained by a silver halide photographic light-sensitive material composed of a support having thereon at least one photosensitive silver halide emulsion layer, at least one layer of the material containing a compound represented by formula (I):

$$A—X—Y—B \qquad (I)$$

wherein A represents a substituted or unsubstituted alkyl group, a substituted or unsubstituted alkenyl group or a substituted or unsubstituted aralkyl group, each having from 8 to 25 atoms; X represents $$-O-,\ -\underset{\underset{O}{\|}}{C}O-,\ -S-,\ -\overset{\overset{R}{|}}{N}-,\ -\overset{\overset{R}{|}}{C}ON-\ \text{or}\ -SO_2\overset{\overset{R}{|}}{N},$$

wherein R represents an alkyl group having from 1 to 10 atoms or —Y—B; Y represents a group containing units $$\left(CH_2CH_2O\right)_a,\ \left(CH_2\underset{\underset{OH}{|}}{C}HCH_2O\right)_b\ \text{and}$$

$$\left(\left(CH_2\right)_c\underset{\underset{R'}{|}}{C}H-CH_2O\right)_d,$$

wherein a is a number from 5 to 50 , preferably from 5 to 20; and b is a number from 2 to 20, preferably from 2 to 10; c is a number from 0 to 3; d is a number from 0 to 20; R′ represents a hydrogen atom, a methyl group or a phenyl group, with the proviso that, when R′ represents a methyl group or a phenyl group, c represents 0, and, when R′ represents a hydrogen atom, c represents a number from 1 to 3; and B represents a hydrogen atom, a substituted or unsubstituted alkyl group having at most 8 carbon atoms or a substituted or unsubstituted phenyl group.

DETAILED DESCRIPTION OF THE INVENTION

In formula (I), A is preferably an alkyl group having 8 to 18 carbon atoms or an aralkyl group having 8 to 16 carbon atoms, and, more preferably an alkyl group having 10 to 18 carbon atoms or an aralkyl group having 8 to 12 carbon atoms. X is preferably —O— or $$-\overset{R}{\overset{|}{N}}-$$

where defined above, and, more preferably —O—. R is preferably an alkyl group having 1 to 8 carbon atoms, and, more preferably an alkyl group having 1 to 6 carbon atoms. B is preferably a hydrogen atom, an alkyl group having 1 to 4 carbon atoms or a phenyl group, and, more preferably a hydrogen atom.

Preferred examples of A include $C_8H_{17}$—, $C_{16}H_{33}$—,

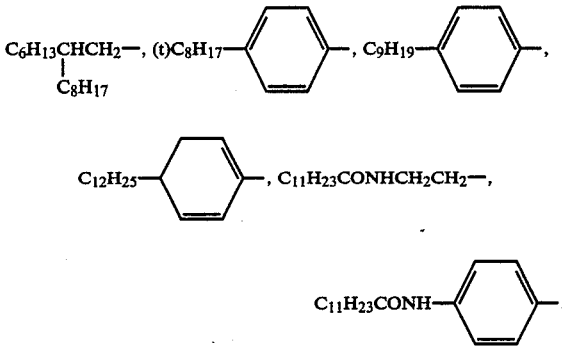

Preferred examples of Y include

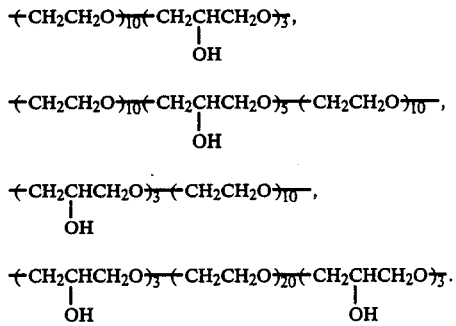

Preferred examples of B include H,

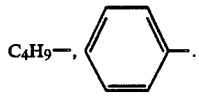

Preferred examples of R′include a methyl group.

Specific examples of the compounds of formula (I) for use in the present invention are disclosed below, but the present invention is not to be construed as being limited thereto:

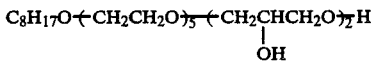

(1)

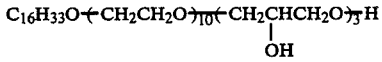

(2)

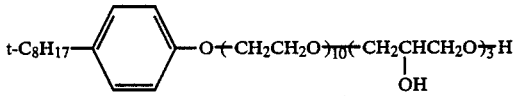

(3)

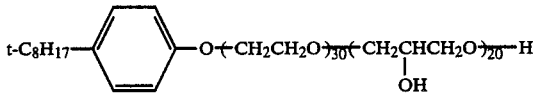

(4)

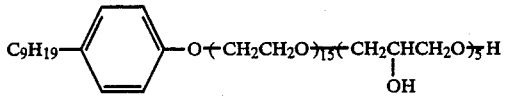

(5)

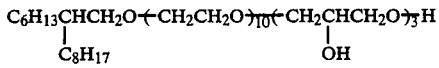

(6)

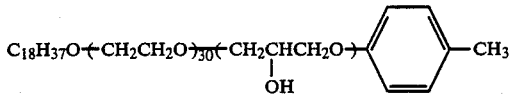

(7)

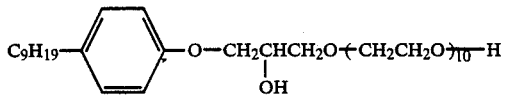

(8)

-continued (9)

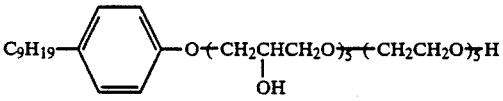

(10)

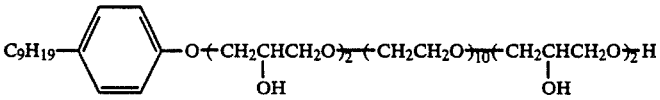

(11)

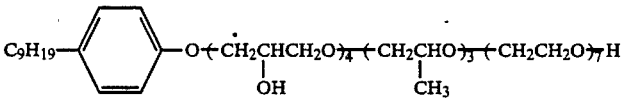

(12)

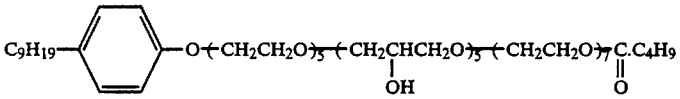

(13)

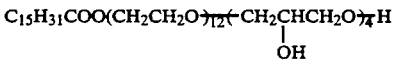

(14)

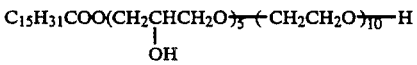

(15)

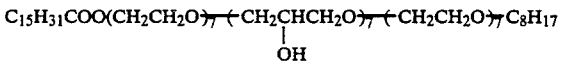

(16)

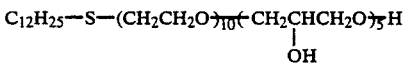

(17)

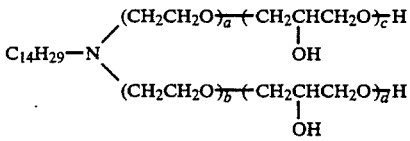

wherein a + b = 15 and c + d = 5

(18)

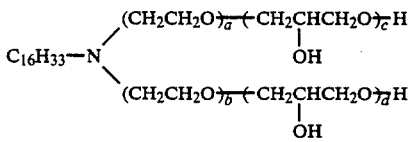

wherein a + b = 20 and c + d = 10

(19)

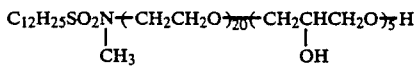

(20)

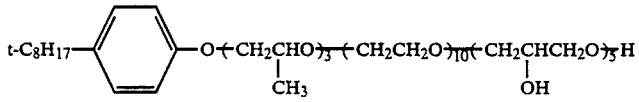

The compounds of formula (I) are characterized by having both an ethylene oxide group (mean added molar number of 5 or more) and a glycidol group in the molecule. The mean added molar number of the ethylene oxide group in the molecule is required to be at least 5 from the viewpoint of the antistatic properties (surface resistance-reducing capacity). If this is less than 5, the function is insufficient, as explained in detail in the following examples.

It has been found that the glycidol group in the molecule specifically improves the solubility of the compounds of formula (I) in photographic processing solutions (having an ion strength of from 2 to 3). It has further been found that this function is closely related to the improvement of the present invention which is directed to elimination of staining of processing solutions.

The compounds of the formula (I) for use in the present invention can be produced in a conventional manner, as illustrated by the following synthesis example.

SYNTHESIS EXAMPLE

Production Of Compound No. 3

97.0 g (0.15 mol) of dry

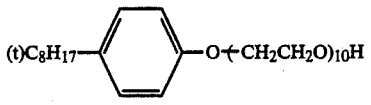

and 3.9 g of NaOH were put in a 300 ml flask provided with a stirrer, a reflux condenser, a thermometer and a dropping funnel and heated at 155 to 160° C. and stirred.

While keeping the internal temperature at 155 to 160° C., 33.3 g (0.45 mol) of glycidol was dropwise added over about 1.5 hours. After the dropwise addition, the mixture was stirred for 7 hours at 160° C. and reacted. At this point, no unreacted glycidol was found at all. After cooling, 100 ml of ethanol was added and dissolved, and the resulting solution was neutralized with a concentrated hydrochloric acid solution.

After the solvent was removed by distillation under reduced pressure, 200 ml of toluene was added and the reaction product was re-dissolved, and then the resulting solution was decolored with active charcoal under heat and thereafter filtered. The solvent was removed by distillation under reduced pressure, whereby a pale yellow viscous liquid was obtained. This was confirmed to be the intended product by IR and NMR. The reaction mixture contained a portion of a reaction product having a secondary OH group produced by a reaction with the glycidol group. The product had a surface tension (1%) of 34 dyn/cm.

In the practice of the present invention, the compounds of formula (I) can be added to a hydrophilic organic colloid or an organic solvent series coating composition for a backing layer provided on the support, where they function as an antistatic agent in the photographic materials of the present invention.

Moreover, the compounds of formula (I) can be added to at least one layer of the silver halide emulsion layers or other constitutional layers of the photographic material. Other constitutional layers are preferably hydrophilic colloidal layers, for example, including a surface protective layer, a backing layer, an interlayer, a subbing layer, etc. Most preferably, the compounds of formula (I) are added to a surface protective layer and/or a backing layer.

If the surface protective layer or backing layer contains two layers, the compounds of formula (I) can be added to any one of them. Alternatively, the compounds of formula (I) can be added to an over-coat layer superposed over the surface protective layer.

For application of the compounds of the formula (I) of the present invention to photographic materials, the compound is first dissolved in an organic solvent such as methanol, isopropanol, acetone, etc. or a mixed solvent thereof and then added to a coating composition for surface protective layer, backing layer, etc., and thereafter the resulting mixture is coated by dip-coating, air knife-coating or spraying, or is coated by the extrusion coating method described in U.S. Pat. No. 2,681,294. Preferably, two or more layers are simultaneously coated, for example, by the methods described in U.S. Pat. No. 3,508,947, 2,941,898, 3,526,528, etc. Alternatively, photographic materials can be dipped in an antistatic agent-containing solution. If desired, an antistatic agent solution containing the compound of formula (I) of the present invention, which solution may optionally contain a binder, can be superposed over the protective layer of photographic materials.

The amount of the compound of the formula (I) incorporated into photographic materials is preferably from about 0.0001 to about 2 g, more preferably from about 0.0005 to about 0.3 g, most preferably from 0.005 to 0.2 g, per $m^2$ of the material.

Two or more compounds of formula (I) can be used in admixture.

Photographic light-sensitive materials to which the compounds of the formula (I) of the present invention can be added include general black-and-white silver halide photographic materials (for example, black-and-white photographic materials for picture-taking, black-and-white photographic materials for X-ray films, black-and-white photographic materials for printing, etc.), general multilayer color photographic materials (for example, color negative films, color reversal films, color positive films, color negative films for motion pictures, etc.), infrared light-sensitive materials for laser scanner printing ,etc.

In the practice of the present invention, the silver halides, their manufacture, chemical ripening of silver halides, anti-foggants, stabilizers, hardening agents, antistatic agents, couplers, plasticizers, lubricants, coating aids, matting agents, whitening agents, spectral sensitizers, dyes, ultraviolet absorbents, etc. for the silver halide emulsion layers, surface protective layers, and other layers of the photographic materials are not particularly limited, and any conventional materials can be used, including those disclosed in *Product Licensing*, Vol. 92, pages 107 to 110 (December 1971), *Research Disclosure*, Vol. 176, pages 22 to 21 (December 19781) and ibid., Vol. 238, pages 44 to 46 (1984).

The photographic materials of the present invention can contain in the photographic emulsion layers or in any other hydrophilic colloid layers, various surfactants for various purposes, for example, for coating assistance, static charge prevention, improvement of lubrication, emulsification and dispersion, prevention of blocking and improvement of photographic characteristics (such as acceleration of developability, elevation of contrast, sensitization, etc.).

Surfactants which can be used for these purposes include, for example, non-ionic surfactants such as saponins (steroid series), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkyl amines or amides, silicone-polyethylene oxide adducts, etc.), glycidol derivatives (e.g., alkenylsuccinic acid polyglycerides, alkylphenol polyglycerides, etc.), fatty acid esters of polyhydric alcohols, alkyl esters of saccharides, etc.; anionic surfactants containing acid groups, for example, a carboxyl group, sulfo group, phospho group, sulfuric acid ester group, phosphoric acid ester group, etc., such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurins, sulfosuccinie acid esters, sulfoalkylpolyoxyethylene alkylphenyl ethers, polyoxyethylene alkylphosphoric acid esters, etc.; ampholytic surfactants such as amino acids, aminoalkylsulfonic acids, aminoalkylsulfuric acid or phosphoric acid esters, alkylbetaines, aminoxides, etc.; and cationic surfactants such as alkylamine salts, aliphatic or aromatic quaternary ammonium salts, heterocyclic quaternary ammonium salts (e.g., pyridinium salts, imidazolium salts, etc.), aliphatic or hetero ring-containing phosphonium or sulfonium salts, etc.

These surfactants are described in R. Oda et al, *Surfactants and Application Thereof* (Maki Publishing Co., 1964); H. Horiguchi, *New Surfactants* (Sankyo Publishing Co., 1975); *McCutcheon's Detergents & Emulsifiers* (by McCutcheon Divisions, MC Publishing Co., 1985); and Japanese Patent Application (OPI) Nos. 76741/85, 172343/87, 173459/87, 215272/87, etc.

As an antistatic agent can be used the fluorine-containing surfactants or polymers described in Japanese Patent Application (OPI) Nos. 109044/87 and 215272/87; the nonionic surfactants described in Japanese Patent Application (OPI) Nos. 76742/85, 80846/85, 80848/85, 80839/85, 76741/85, 208743/83, 162343/87, 173459/87, 215262/87, etc.; and the electroconductive polymers or latexes (nonionic, aninonic, cationic or ampholytic) described in Japanese Patent Application (OPI) Nos. 204540/82 and 214272/87. As an inorganic antistatic agent can be used ammonium, alkali metal or alkaline earth metal halides, nitrates, perchlorates, sulfates, acetates, phosphates, thiocyanates, etc. In addition, electroconductive tin oxides and zinc oxides and complex oxides formed by doping antimony or the like to these metal oxides, which are described in Japanese Patent Application (OPI) No. 118242/82, are preferably used. Further, various kinds of charge-transfer complexes, $\pi$-conjugated system polymers and doped products thereof, organic metal compounds, interlayer compounds, etc. can also be utilized as an antistatic agent, including, for example, TCNQ/TTF, polyacetylene, polypyrrole, etc. These are described in Morita et al, *Science and Industry*, 59 (3), 103–111 (1985), and ibid., 59 (4), 146–152 (1985).

Gelatin is advantageously used as a binder or protective colloid for emulsion layers or interlayers in the photographic materials of the present invention, but any other hydrophilic colloids can also be used.

For example, proteins such as gelatin derivatives, graft polymers of gelatin and other polymers, albumin, casein, etc.; saccharide derivatives such as cellulose derivatives, for example, hydroxyethyl cellulose, carboxymethyl cellulose, cellulose sulfates, etc., sodium alginate, dextran, starch derivatives, etc.; and various kinds of synthetic hydrophilic polymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. can be used.

As gelatin, lime-processed gelatin as well as acid-processed gelatin or enzyme-processed gelatin can be used. Also, the hydrolyzed products or enzyme decomposed products of gelatin can be used.

It is preferred to use dextran and polyacrylamide together with gelatin.

In the hydrophilic colloidal layers of the photographic material of the present invention can be incorporated polyols, such as trimethylol-propane, pentanediol, butane-diol, ethylene glycol, glycerin, sorbitol, etc., as a plasticizer.

The silver halide grains in the photographic emulsion of the photographic material of the present invention may have a regular crystal form, such as cubic or octahedral, or a crystal form, such as spherical or tabular, or further a composite form of these crystal forms. Also, the tabular grains described in *Research Disclosure*, Vol. 225, No. 22534, pages 20 to 58 (Jan. 1983), Japanese Patent Application (OPI) Nos. 127921/83, 113926/83, etc. can also be used. Further, the emulsion for use in the present invention can be a mixture of various grains with different crystal forms.

Metal ion(s) can be added to the silver halide grains, during the step of formation of grains and/or growth thereof, using at least one of cadmium salts, zinc salts, lead salts, thallium salts, iridium salts (including complexes), rhodium salts (including complexes) and iron salts (including complexes), so that the metal element(s) are incorporated into the inside of the grains and/or added to the surface thereof; or the silver halide grains may be kept in a reducing atmosphere so that reductive sensitizing nuclei are incorporated into the inside of the grains and/or added to the surface thereof.

After the completion of the growth of the silver halide grains, unnecessary soluble salts can be removed from the silver halide emulsion, or these can be kept therein. The removal of such soluble salts can be carried out by the method described in Research Disclosure, No. 17643, Item II (December 1978).

The silver halide grains can have a uniform silver halide composition distribution in the inside of the grains, or they may be core/shell grains which have different silver halide compositions in the inside and the surface of the grains.

The grain size distribution of the silver halide emulsion for use in the present invention is not particularly limited. An emulsion with a broad grain size distribution (hereinafter referred to as a "polydisperse emulsion") can be used; or an emulsion with a narrow grain size distribution (hereinafter referred to as a "monodisperse emulsion") can also be used singly or in mixture of several kinds. (The term "monodisperse emulsion" means that the value (fluctuation) obtained by dividing the standard deviation in the grain distribution curve by the mean grain size is about 0.20 or less. The term "grain size" means the diameter of the grain in the case of spherical silver halide grains, or the diameter of a circle having the same area as the project area of the grain in the case of other grains than spherical grains.) Further, a mixture of polydisperse emulsion(s) and monodisperse emulsion(s) can also be used.

The emulsion for use in the present invention may be a mixed emulsion containing a light-sensitive silver halide emulsion and an internal-fogged silver halide emulsion, as described in U.S. Pat. Nos. 2,996,382, 3,397,987 and 3,705,858; or these emulsions can form the respective layers in one photographic material. Incorporation of the mercapto compound described in Japanese Patent Application (OPI) No. 48832/86 into the emulsions is more preferred from the viewpoint of prevention of fogging, improvement of storage stability, etc.

Various compounds can be incorporated into the photographic emulsion for use in the present invention, for the purpose of preventing fog during manufacture, storage and photographic processing of photographic materials or of stabilizing the photographic characteristics of the materials. For example, various compounds which are known antifoggants or stabilizers can be used for these purposes, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines such as thioketo compounds (e.g., oxazolinethione); azaindenes such as triazaindenes, tetrazaindenes (especially 4-hydroxy-substituted (1,3,3a,7)-tetrazaindenes), pentazaindenes, etc.; benzenethiosulfonic acids, benzenesulfinic acids, benzenesulfonic acid amides, etc.

The photographic materials of the present invention can contain in the hydrophilic colloid layer, a polymer latex which is well known in this technical field, such as homopolymers or copolymers of alkyl acrylates or copolymers of vinylidene chloride, etc. The polymer latex may previously be stabilized with a nonionic surfactant, as described in Japanese Patent Application (OPI) No. 230136/86.

The photographic emulsion layer of the photographic materials of the present invention can contain, for the purpose of elevation of sensitivity, enhancement of contrast and acceleration of development, for example, polyalkylene oxides or ether, ester or amine derivatives thereof, thioether compounds, thiomorpholines, quaternary ammonium salt compounds, urethane derivatives, urea derivatives, imidazole derivatives, 3-pyrazolidones, etc.

The photographic emulsion for use in the present invention can be spectrally sensitized with methine dyes or the like, including cyanine dyes, merocyanine dyes, complex cyanine dyes, complex merocyanine dyes, holopolar cyanine dyes, hemicyanine dyes, styryl dyes and hemioxonole dyes. Especially useful dyes are cyanine dyes, merocyanine dyes and complex merocyanine dyes.

The support for use in the present invention may be provided with an anti-halation layer, containing carbon black and various dyes such as oxonole dyes, azo dyes, arylidene dyes, styryl dyes, anthraquinone dyes, merocyanine dyes and tri (or di-)arylmethane dyes, etc. In this case, a cationic polymer or latex can be used so that the dye does not diffuse out from the anti-halation layer. This technique is described in *Research Disclosure,* Vol. 176, No. 17643, Item VIII (December 1978). In addition, the magenta dyes described in Japanese Patent Application (OPI) No. 285445/86 can also be used for the purpose of improving the color tone of developed silver.

The hydrophilic colloid layer in the photographic material of the present invention can contain matting agent, for example, containing grains of colloidal silica, barium strontium sulfate, polymethyl methacrylate, methyl methacrylate-methacrylic acid copolymer, the methyl methacrylate-styrenesulfonic acid copolymer described in Japanese Patent Application No. 50684/87, the fluorine-containing compound described in Japanese Patent Application (OPI) No. 230136/86, etc.

The photographic material of the present invention can contain an inorganic or organic hardening agent in the photographic emulsion layer or any other layers. For example, aldehydes (e.g., formaldehyde, glyoxal, glutaraldehyde, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-striazine, etc.), mucohalogenic acids (e.g., mucochloric acid, mucophenoxychloric acid, etc.), can be used singly or in combination, for this purpose.

Preferred hardening agents are vinylsulfone series compounds represented by general formula:

$$(CH_2{=}CH{=}SO_2{-})_2A$$

in which A represents a divalent group, or a single bond.

The photographic material of the present invention can contain a developing agent. As the developing agent can be used the compounds described in *Research Disclosure,* Vol. 176, page 29, "Developing Agents".

In particular, hydroquinones and pyrazolidones are preferably used.

In the present invention can be used yellow couplers, cyan couplers and magenta couplers as described, for example, in Japanese Patent Application (OPI) No. 215272/87.

The development of the photographic material of the present invention may be either for formation of silver images (black-and-white development) or for formation of color images. For formation of images by a reversal method, the material is first subjected to black-and-white negative development and then is exposed to white light or is subjected to color development in a fogging agent-containing bath. (Alternatively, a dye can be incorporated into the photographic material and the material can be processed by a silver dye bleaching method where the material is, after exposure, subjected to black-and-white development to form a silver image, and the dye in the material is bleached with the thus-formed silver image as a bleaching catalyst.)

The black-and-white development process typically includes development, fixation and rinsing in water. If the development step is followed by a stopping step or the fixation step is followed by a stabilization step, the rinsing-in-water step can be omitted. It is also possible to incorporate a developing agent or a precursor thereof into the photographic material so that the development can be carried out using only an alkaline solution. Developers include a lith developer in the development step mentioned above.

The color development process typically includes color development, bleaching, fixation, rinsing in water and optionally stabilization. A combined bleach-fixation step can be carried out by the use of a mono-bath bleach-fixing solution, in place of the bleaching step with a bleaching solution and the fixation step with a fixing solution. Also, a mono-bath processing step using a mono-bath developing-bleaching-fixing solution can be carried out, where color development, bleaching and fixation are performed in one bath.

In combination with these processing steps, a prehardening step, a neutralization step, a stopping fixation step, a post-hardening step, etc. can be used. For carrying out these steps, a color developing agent or a precursor thereof can previously be incorporated into the photographic material to be processed so that the material is processed with an activator solution (activator-processing step) in place of a color developer for color development. Alternatively, the activator processing step can be combined with the above-mentioned mono-bath processing step.

The processing temperature may be selected from the range of from about 10° C. to 65° C., but the temperature may be higher than 65° C. Preferably, the photographic material of the present invention is processed at a temperature of from about 25° C. to 45° C.

The black-and-white developer for the black-and-white development of the photographic material of the present invention may be any one which is generally used for conventional black-and-white photographic materials, and various additives which are generally added to conventional black-and-white developers can be incorporated into the developer for the materials of the present invention.

The additives typically include a developing agent such as 1-phenyl-3-pyrazolidone, Metol and hydroquinone; a preservative such as sulfites; an accelerating agent such as sodium hydroxide, sodium carbonate, potassium carbonate and similar alkalis; an inorganic or organic inhibitor such as potassium bromide, 2-methylbenzimidazole, methylbenzothiazole, etc.; a water softener such as polyphosphoric acid salts; a surface superdevelopment inhibitor such as a slight amount of iodides or mercapto compounds, etc.

Recently, in the field of X-ray photographic materials, a shortening of development processing time is actively sought. Further, various means for simplifying the processing of the materials are also being developed. The compounds of formula (I) of the present invention are extremely helpful for producing improved photographic materials which are suitable for these recent techniques.

The present invention is now illustrated in greater detail with reference to the following examples, which are not to be construed as limiting the scope of the present invention in any way. Unless otherwise indicated, all parts, percents and ratios are by weight.

EXAMPLE 1

(1) Preparation of Monodisperse Silver Halide Emulsion

An appropriate amount of ammonia was put in a container containing gelatin, potassium bromide and water and warmed at 55° C., and then an aqueous silver nitrate solution and an aqueous potassium bromide solution to which was added hexachloroiridate (III) in an amount of $10^{-7}$ mol (as a molar ratio of iridium to silver) were added by a double-jet method, while the pAg value in the reaction container was kept at 7.60, to prepare monodisperse silver bromide emulsion grains having a mean grain size of 0.55 μm. In the emulsion, grains having a grain size falling within the range of mean grain size ±40% accounted for 98% by number of the total grains. After subjecting the emulsion to desalting treatment, the emulsion was adjusted to pH of 8.6, and thereafter this was gold and sulfur sensitized with sodium thiosulfate and chloroauric acid to obtain the desired photographic property.

The plane ratio of (100)/(111) of the emulsion grains was determined by the Kubelka-Munk Method to be 98/2. The emulsion was designated as Emulsion (A).

In the same manner as in the preparation of Emulsion (A), except that the amount of ammonia added before formation of silver halide grains was reduced, other monodisperse Emulsions (B) and (C) were prepared, having a mean grain size of 0.35 μm and 0.25 μm, respectively.

(2) Preparation of Emulsion Coating Composition 0.333 kg of each of the Emulsions (A), (B) and (C) was heated at 40° C. for dissolution, and 70 cc of a methanol solution of an infrared sensitizing dye (having the following structural formula A) ($9\times10^{-4}$ mol/liter), 90 cc of an aqueous solution of a super color sensitizer of disodium 4,4'-bis[2,6-di(naphthyl-4oxy)-pyrimidin-2ylamino]stilbene2,2'-disulfonate ($4.4\times10^{-3}$ mol/liter), 35 cc of a methanol solution of a compound having the following structural formula B ($2.8\times10^{-3}$ 1 2 mol/liter), a 2% aqueous solution of 4-hydroxy-6-methyl-1,3,3a,7-tetrazaindene, polymer grains of methyl methacrylate and methacrylic acid (molar ratio 95/5) which had a mean grain size of 0.08 μm and which had previously been processed with 3 w/v% of the grain weight of compound No. 3 of the invention, 20 ml of a 5% aqueous solution of a coating aid (dodecylbenzenesulfonic acid salt) and 110 ml of a 4% aqueous solution of a tackifier (polypotassium-p-styrenesulfonate compound) were added to prepare emulsion coating compositions.

Infrared Sensitizing Dye (A):

-continued

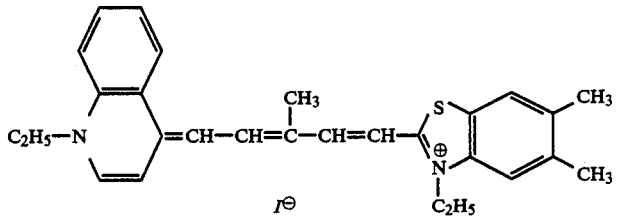

Compound (B):

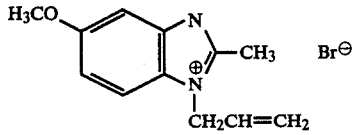

(3) Preparation of Coating Composition for Surface Protective Layer over the Light-Sensitive Layer To an aqueous 10 wt% gelatin solution (0.9 g/m$^2$) heated at 40° C. were added an aqueous polyacrylamide solution (molecular weight 40,000) (0.1 g/m$^2$), an aqueous dextran solution (molecular weight 35,000) (0.4 g/m$^2$), an aqueous solution of a tackifier (sodium polystyrenesulfonate), a matting agent of polymethyl methacrylate (mean grain size 2.0 μm), a hardening agent (N,N'-ethylenebis(vinylsulfonyacetamide), an aqueous solution of a coating aid (sodium t-octylphenoxyethoxyethoxyethanesulfonate (20 mg/m$^2$) and the following compounds, to prepare a coating composition. All coating weights in the final layer are dry weight.

$C_8F_{17}SO_3K$ (1 mg/m$^2$)

$$C_8F_{17}SO_2N(C_3H_7)(CH_2CH_2O)_5(CH_2)_4SO_3Na \quad (1\ mg/m^2)$$

In addition, the compound of the invention was add d as indicated in Table 1 below.

(4) Preparation of Coating Composition for a Backing Layer

To 1 kg of an aqueous 10 wt% gelatin solution heated at 40° C. were added an aqueous solution of a tackifier (sodium polystyrenesulfonate), 50 cc of an aqueous solution of a dye having the following structural formula C ($5\times10^{-2}$ mol/liter), an aqueous solution of a hardening agent (N,N'-ethylenebis(vinylsulfonylacetamide)), an aqueous solution of a coating aid (sodium t-octylphenoxyethoxyethoxyethanesulfonate) and polymer grains of methyl methacrylate and methacrylic acid (molar ratio 95/5) having a mean grain size of 0.1 μm, to prepare a coating composition.

Dye (C):

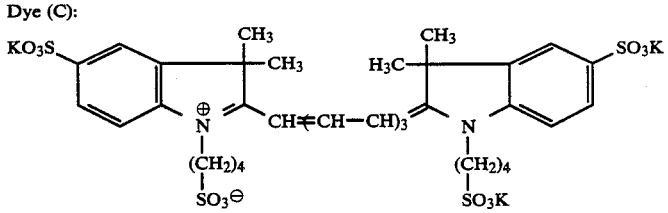

(5) Preparation of Coating Composition for Surface Protective Layer over the Backing Layer To an aqueous 10 wt% gelatin solution (1 g/m$^2$) heated at 40° C. were added an aqueous solution of a tackifier (sodium polystyrenesulfonate) (30 mg/m$^2$), a matting agent of polymer grains of methyl methacrylate-sodium styrenesulfonate (molar ratio 97/3, mean grain size 3.5 μm) (50 mg/m$^2$), an aqueous solution of a coating aid (sodium t-octylphenoxyethoxyethoxyethanesulfonate) (20 mg/m$^2$), an aqueous solution of sodium p-nonylphenoxybutylsulfonate, $C_8F_{17}SO_3K$ (1 mg/m$^2$), $$C_8F_{17}SO_2N(C_3H_7)(CH_2CH_2O)_4(CH_2)_4SO_3Na \quad (1\ mg/m^2)$$

and the compound of the present invention (as indicated in Table 1), to prepare a coating composition.

(6) Preparation of Coated Samples The above-described coating composition of backing layer was coated on one side of a polyethylene terephthalate support having a thickness of about 1 μm together with the surface protective layer-coating composition (for the backing layer), the amount of gelatin coated being 4 g/m$^2$ Subsequently, the infrared sensitizing dye-containing emulsion coating composition (mentioned in the above (2)) was coated on the other side of the support together with the surface protective layer-coating composition (for the emulsion layer), the amount of silver coated being 3.5 g/m$^2$. The amounts of the other additives are disclosed as dry weights above in units of g/m$^2$ or mg/m$^2$. The thus-prepared film samples were tested to evaluate static marks by urethane and nylon rollers, image unevenness, stain of fixing solution and spots on coated samples. (7) The compositions of the developer and fixing solution used were as follows:

| | | |
|---|---|---|
| Developer: | | |
| Potassium Hydroxide | 17 | g |
| Sodium Sulfite | 60 | g |
| Diethylenetriamine-pentaacetic Acid | 2 | g |
| Potassium Carbonate | 5 | g |
| Boric Acid | 3 | g |
| Hydroquinone | 25 | g |
| Diethylene Glycol | 12 | g |
| 4-Hydroxymethyl-4-methyl-1-phenyl-3-pyrazolidone | 1.65 | g |
| 5-Methylbenzotriazole | 0.6 | g |
| Acetic Acid | 1.8 | g |
| Potassium Bromide | 2 | g |
| Water to make | 1 | liter |
| pH | 10.35 | |
| Fixing Solution: | | |
| Ammonium Thiosulfate | 140 | g |
| Sodium Sulfite | 15 | g |
| Ethylenediamine-tetraacetic Acid Disodium Salt Dihydrate | 25 | mg |
| Sodium Hydroxide | 6 | g |
| Water to make | 1 | liter |
| pH | 4.95 | |

The development process included the following steps.

| | Processing Temperature, Time |
|---|---|
| Development | 35° C. × 11.5 sec |
| Fixation | 35° C. × 12.5 sec |
| Rinsing-in-Water | 20° C. × 7.5 sec |
| Drying | 60° C. |
| Dry-to-Dry Processing Time | 60 sec |

(8) Evaluation of Static Marks

Non-exposed samples were conditioned at 25° C. and 10% RH for 2 and then rubbed with a urethane rubber roller and a nylon rubber roller in a dark room under the same atmospheric conditions to examine the generation of static marks on the samples. After being rubber, the samples were developed in the same manner as above.

The generation or static marks was evaluated on the basis of the following four ranks.

A: No static marks.
B: Some static marks appeared.
C: Significant static marks appeared.
D: Extreme static marks appeared.

(9) Evaluation of Image Unevenness

Film samples (25 cm×30 cm) were irradiated with infrared light to provide an image density after development of 1.5 as measured by a Macbeth Densitometer. The exposed samples were developed, fixed, rinsed in water and dried in the same manner as mentioned above. The unevenness of the image formed wa evaluated on the basis of the following four ranks.

A: No image unevenness (Image was quite even).
B: Some image unevenness.
C: Fairly noticeable image unevenness.
D: Extreme image unevenness.

(10) Evaluation of Stain of Fixing Solution

Film samples (25 cm×30 cm) infrared exposed to have a density of 1.5 (measured by a Macbeth Densitometer) were developed with a freshly prepared developer and a fixing solution, and 500 sheets were processed in these solutions, using an amount of replenisher for the developer and for the fixing solution of 50 cc/sheet and 60 cc/sheet, respectively. After the process, the insoluble substances floating in the fixing solution were evaluated on the basis of the following four ranks.

A: No floating substances.
B: Some floating substances.
C: Significant amounts of floating substances.
D: Extreme amounts of floating substances.

Evaluation of Coatability

The evaluation of coatability was effected on the basis of the number of spots on the emulsion layer side, per m $^2$ of the film sample, i.e., a larger number means that the coatability was worse.

TABLE 1

| Sample No. | Compound in Protective Layer (Emulsion Layer, Backing Layer) Compound | Content (mg/m$^2$) | Static Marks Urethane | Static Marks Nylon | Image Unevenness | Stain of Fixer | Coatability (Number of Spots |
|---|---|---|---|---|---|---|---|
| 1-1 (Control) | — | — | D | D | D | A | 1 |
| 1-2 (The Invention) | Compound No. 2 | 45 | A | A | A | A | 2 |
| 1-3 (The Invention) | Compound No. 3 | 50 | A | A | A | A | 2 |
| 1-4 (The Invention) | Compound No. 5 | 70 | A | A | A | A | 4 |
| 1-5 (The Invention) | Compound No. 6 | 50 | A | A | A | A | 1 |
| 1-6 (The Invention) | Compound No. 10 | 45 | A | A | A | A | 3 |
| 1-7 (The Invention) | Compound No. 13 | 45 | A | A | A | A | 1 |
| 1-8 (Comparison) | Comparative Compound A | 45 | A | A | D | D | 2 |
| 1-9 (Comparison) | Comparative Compound B | 45 | A | A | D | D | 3 |
| 1-10 (Comparison) | Comparative | 45 | D | D | B | A | 2 |

TABLE 1-continued

| Sample No. | Compound in Protective Layer (Emulsion Layer, Backing Layer) Compound | Content ($mg/m^2$) | Static Marks Urethane | Static Marks Nylon | Image Unevenness | Stain of Fixer | Coatability (Number of Spots |
|---|---|---|---|---|---|---|---|
| 1-11 (Comparison) | Compound C Comparative Compound D | 45 | C | B | D | D | 5 |
| 1-12 (Comparison) | Comparative Compound E | 45 | A | B | D | D | 3 |

Comparative Compound (A):
$C_{16}H_{33}O(-CH_2CH_2O-)_{10}H$
Comparative Compound (B):

Comparative Compound (C):

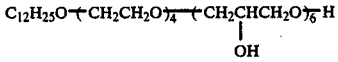

Comparative Compound (D):

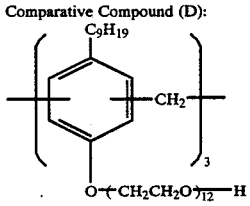

Comparative Compound (E):
$C_{15}H_{31}COO(-CH_2CH_2O-)_{15}H$

The results of Table 1 demonstrate that the Samples (I-2) to (I-7) containing the compound of the invention were good, since no static marks occurred, the images formed were even and the fixing solution used was not stained. In addition, the surface state of the film coated (coatability) was good.

On the other hand, in Sample (I-1) (control) not containing the compound of the invention, the formation of the static marks was extreme and the image was extremely uneven. The image formed was practically unacceptable. The Comparative Samples (I-8), (I-11) and (I-12) containing a polyoxyethylene group-containing nonionic surfactant were extremely inferior to the Samples of the present invention in image evenness and the stain prevention of fixing solution. Comparative Samples (I-9) and (I-10) contained a compound structurally similar to the compound of the invention but outside the scope of the present invention. However, Sample (I-9) was noticeably inferior to the Samples of the present invention of fixing solution; and Sample (I-1 0) was also noticeably inferior to the Samples of the present invention in static marks.

From the above results, it is apparent that the film samples prepared by the use of the compound of the present invention were excellent with respect to preventing static marks; image evenness, prevention of stain of fixing solution and the surface state of the coated film.

EXAMPLE 2

(1) Preparation of Tabular Silver Halide Grains

Potassium-bromide, thioether $(HO(CH_2)_2S(C)_2S(CH_2OH)$ and gelatin were dissolved and the resulting solution was kept at 70° C. To this were added a silver nitrate solution and a mixed solution of potassium iodide and potassium bromide by double-jet method, with stirring. After the completion of the addition, the temperature of the resulting mixture was lowered down to 35° C. and soluble salts were removed by precipitation. Afterwards, the resulting solution was again heated to 40° C., and 60 g of gelatin was added thereto and dissolved, and the pH of the solution was adjusted to 6.8. Thus tabular silver halide grains were formed, having a mean grain size (diameter) of 1.24 μm, a thickness of 0.17 μm, a mean aspect ratio (diameter/thickness) of 7.3 and a silver iodide content of 3 mol%. At 40° C, the pAg value was 8.95.

The emulsion was chemically sensitized by a combination of gold sensitization and sulfur sensitization. After being chemically sensitized, a sensitizing dye (anhydro-5,5'-dichloro-9-ethyl-3,3 '-di(3-sulfopropyl-)oxacarboxyaninehydroxide sodium salt; 500 mg per mol of silver) and potassium iodide (200 mg per mol of silver) were added to the resulting emulsion for green-sensitization. Further, a stabilizer 4-hydroxy-6-methyl-l-,3,3a,7-tetrazaindene and 2,6-bis(hydroxyamino)-4-dinoethylamino-l,3,5-triazine as well as a dextran having a weight mean molecular weight (MW) of 40,0000 and a latex solution of ethyl acrylate/acrylic acid (molar ratio of 95/5) and the following nonionic surfactant (a) in an amount of 3% by weight of the latex solid content were added, to obtain a tabular grain-containing coating composition for an emulsion layer. The coating composition had specific weight of 1.175; the weight ratio of silver/ gelatin in the composition was 1.30; and that of dextran/ gelatin therein was 0.30.

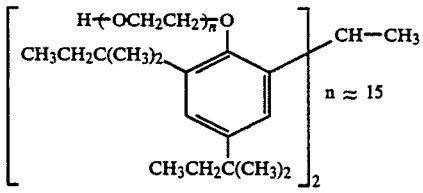

(2) Preparation of Coating Composition for Surface Protective Layer

Gelatin was blended with a coating aid (sodium p-toctylphenoxyethoxyethoxyethanesulfonate), fluorine-containing surfactant A $C_8F_{17}SO_3K$, and surfactant B a hardening agent (N,N'-ethylenebis-(vinylsulfonylacetamide)), polyacrylamide having a weight mean molecular weight (MW) of 8,000, dextran having a weight mean molecular weight of about 35,000, polymethyl methacrylate grains (mean grain size 3.5 μm), sodium polyacrylate, potassium polystyrenesulfonate and an aqueous 5 wt% gelatin solution containing the compound of the invention (as indicated in Table 2 below), to prepare a coating composition for a surface protective layer. The weight ratio of polyacrylamide/-gelatin was 1:1.

(3) Preparation of Photographic Material Samples:

The emulsion layer-coating composition and the surface protective layer-containing composition prepared above were coated on a polyethylene terephthalate film support having a thickness of 180 μm and having a subbing layer, by simultaneous extrusion, and dried, the amount of silver coated being 2.0 g/m$^2$. The surface protective layer thus formed contained 0.75 g/m$^2$ of gelatin, 20 mg/m$^2$ of sodium p-t-octylphenoxyethoxyethoxyethanesulfonate,3 mg/m$^2$ and 1 mg/m$^2$ of fluorine-containing surfactants, A and B, respectively, 20 mg/m$^2$ of hardening agent and 0.75 g/m$^{In\ addition,\ the\ opposite\ side\ of\ the\ support\ was\ also\ coated\ in\ the\ same\ manner\ with\ the\ subbing\ layer,\ emulsion\ layer\ an\ protective\ layer.}$ The samples thus prepared were examined in the same manner as Example 1 with respect to static marks, image unevenness, stain of fixing solution and coatability (coating spots). The development, fixation and rinsing-in-water steps were same as in Example 1, except that 5 g of glutaraldehyde was added to the developer and 10 g of potassium aluminium sulfate was added to the fixing solution. The results obtained are shown in Table 2 below.

TABLE 2

| Sample No. | Compound in Protective Layer (Emulsion Layer, Backing Layer) Compound | Content (mg/m$^2$) | Static Marks Urethane | Static Marks Nylon | Image Unevenness | Stain of Fixer | Coatability (Number of Spots |
|---|---|---|---|---|---|---|---|
| 2-1 (Control) | — | — | D | D | D | D | 3 |
| 2-2 (The Invention) | Compound No. 3 | 40 | A | A | A | A | 2 |
| 2-3 (The Invention) | Compound No. 3 | 100 | A | A | A | A | 1 |
| 2-4 (The Invention) | Compound No. 2 | 40 | A | A | A | A | 3 |
| 2-5 (The Invention) | Compound No. 6 | 45 | A | A | A | A | 3 |
| 2-6 (The Invention) | Compound No. 10 | 45 | A | A | A | A | 2 |
| 2-7 (The Invention) | Compound No. 14 | 45 | A | A | A | A | 2 |
| 2-8 (Comparison) | Comparative Compound C | 45 | C | D | B | A | 7 |
| 2-9 (Comparison) | Comparative Compound A | 40 | A | A | D | D | 1 |
| 2-10 (Comparison) | Comparative Compound A | 100 | B | D | D | D | 3 |
| 2-11 (Comparison) | Comparative Compound B | 40 | A | A | D | D | 4 |
| 2-12 (Comparison) | Comparative Compound B | 100 | C | D | D | D | 2 |
| 2-13 (Comparison) | Comparative Compound F | 45 | D | D | B | A | 3 |

Comparative Compound (F):

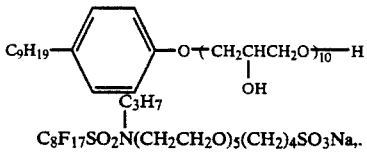

$C_8F_{17}SO_2N(CH_2CH_2O)_5(CH_2)_4SO_3Na$,.

The results of Table 2 demonstrate that the samples containing the compound of the present invention were all excellent, since no static marks occurred; the images formed were even, and the fixing solution used was not stained. In addition, the surface state of the film coated (coatability) was good, and excellent images were formed on the film samples.

In contrast, the control sample was extremely poor because of the severe static marks, image unevenness and stain of the fixing solution used. The comparative samples (Nos. 2-8 to 2-13) did not satisfy all the conditions of prevention of static marks, image evenness and prevention of stain of fixing solution.

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having thereon at least one hydrophilic colloid layer, at least one layer of which is a photosensitive silver halide emulsion layer, at least one hydrophilic colloid layer selected from a photosensitive silver halide emulsion layer, a surface protective layer, a backing layer, an interlayer and a subbing layer contains a compound represented by formula (I) in an amount of from about 0.0001 to about $2g/m^2$ of the photographic element:

$$A—X—Y—B \qquad (I)$$

wherein A represents a substituted or unsubstituted alkyl group, a substituted or unsubstituted alkenyl group or a substituted or unsubstituted aralkyl group, each having from 8 to 25 carbon atoms; X represents $$-O-,\ -\underset{\underset{O}{\|}}{C}O-,\ -S-,\ -\overset{\overset{R}{|}}{N}-,$$

$$-\overset{\overset{R}{|}}{N}CO- \text{ or } -SO_2\overset{\overset{R}{|}}{N};$$

R represents an alkyl group having from 1 to 10 carbon atoms or —Y—B; Y represents a group comprising units $$\left(CH_2CH_2O\right)_a,\ \left(CH_2\underset{\underset{OH}{|}}{C}HCH_2O\right)_b, \text{ and}$$

$$\left(\left(CH_2\right)_c\underset{\underset{R'}{|}}{C}H—CH_2O\right)_d$$

wherein a is a number from 5 to 50; b is a number from 2 to 20; c is a number from 0 to 3; d is a number from 0 to 20; R′ represents a hydrogen atom, a method group or a phenyl group, with the proviso that, when R′ represents a methyl group or a phenyl group, c represents 0, and, when R′ represents a hydrogen atom, c represents a number from 1 to 3; and B represents a hydrogen atom, a substituted or unsubstituted alkyl group having up to 8 carbon atoms or a substituted or unsubstituted phenyl group.

2. A silver halide photographic element as in claim 1, wherein A represents $C_8H_{17}$—, $C_{16}H_{33}$, $C_6H_{13}CHCH_2$—,

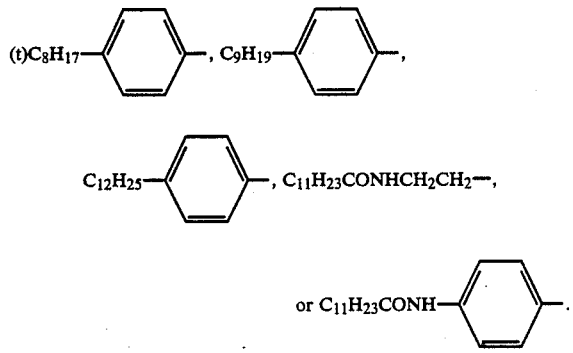

3. A silver halide photographic element as in claim 1, wherein Y represents $$\left(CH_2CH_2O\right)_{10}\left(CH_2\underset{\underset{OH}{|}}{C}HCH_2O\right)_5,$$

$$\left(CH_2CH_2O\right)_{10}\left(CH_2\underset{\underset{OH}{|}}{C}HCH_2O\right)_5\left(CH_2CH_2O\right)_{10},$$

$$\left(CH_2\underset{\underset{OH}{|}}{C}HCH_2O\right)_5\left(CH_2CH_2O\right)_{10}, \text{ or}$$

$$\left(CH_2\underset{\underset{OH}{|}}{C}HCH_2O\right)_5\left(CH_2CH_2O\right)_{20}\left(CH_2\underset{\underset{OH}{|}}{C}HCH_2O\right)_5.$$

4. A silver halide photographic element as in claim 1, wherein B represents H, $C_4H_9$— or

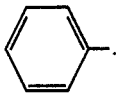

5. The silver halide photographic element as claimed in claim 1, wherein said compound represented by formula (I) is selected from the group consisting of $$C_8H_{17}O\left(CH_2CH_2O\right)_5\left(CH_2\underset{\underset{OH}{|}}{C}HCH_2O\right)_2H; \qquad (1)$$

$$C_{16}H_{33}O\left(CH_2CH_2O\right)_{10}\left(CH_2\underset{\underset{OH}{|}}{C}HCH_2O\right)_5H; \qquad (2)$$

(3)

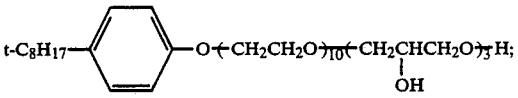

(4)

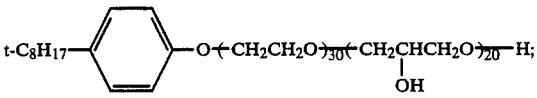

-continued (5)

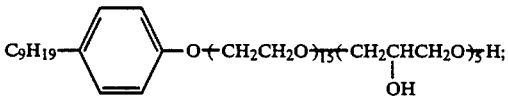

(6)

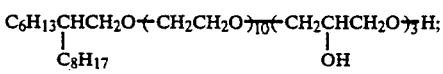

(7)

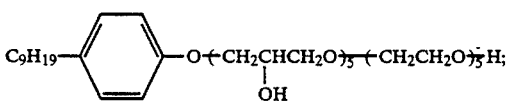

(8)

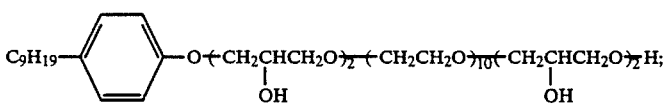

(9)

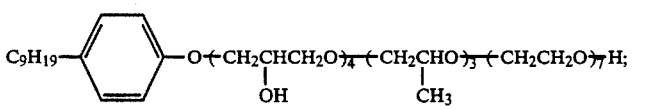

(10)

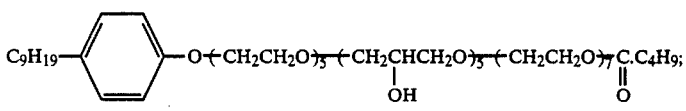

(11)

(12)

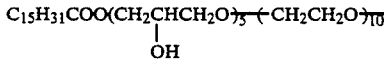

(13)

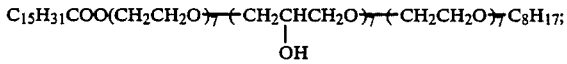

(14)

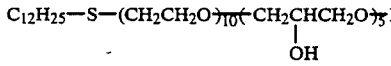

(15)

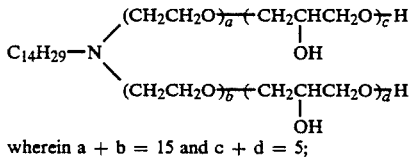

wherein a + b = 15 and c + d = 5;

(16)

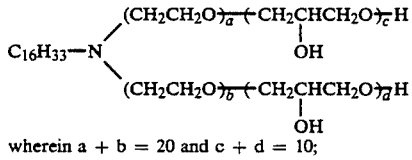

wherein a + b = 20 and c + d = 10;

(17)

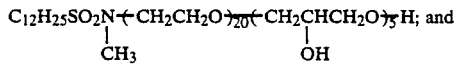

(18)

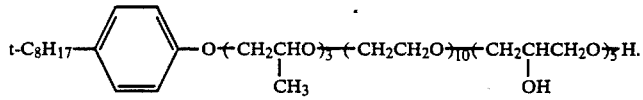

6. The silver halide photographic element as claimed in claim 1, wherein said compound represented by formula (I) is present in at least one of said surface protective layer and said backing layer.

7. The silver halide photographic element as claimed in claim 1, wherein said compound represented by formula (I) is present in an amount of from about 0.0005 to 0.3 g/m$^2$of said material.

8. The silver halide photographic element as claimed in claim 1, wherein a is a number from 5 to 20 and b is a number from 2 to 10 .

* * * * *